US011008793B2

(12) United States Patent
Güzeltepe et al.

(10) Patent No.: US 11,008,793 B2
(45) Date of Patent: May 18, 2021

(54) FLAP HOLDER FOR A FURNITURE FLAP

(71) Applicant: SAMET KALIP VE MADEN ESYA SAN. VE TIC A.S., Esenyurt-Istanbul (TR)

(72) Inventors: Nurettin Güzeltepe, Tepekent (FR); Artur Hirtsiefer, Neunkirchen-Seelscheid (DE); Bernd Rödder, Ruppichteroth (DE)

(73) Assignee: SAMET KALIP VE MADEN ESYA SAN. VE TIC A.S.

( * ) Notice: Subject to any disclaimer, the term of this patent is extended or adjusted under 35 U.S.C. 154(b) by 348 days.

(21) Appl. No.: 15/766,417

(22) PCT Filed: Aug. 2, 2016

(86) PCT No.: PCT/EP2016/068380
§ 371 (c)(1),
(2) Date: Apr. 6, 2018

(87) PCT Pub. No.: WO2017/059982
PCT Pub. Date: Apr. 13, 2017

(65) Prior Publication Data

US 2018/0291665 A1 Oct. 11, 2018

(30) Foreign Application Priority Data

Oct. 9, 2015 (DE) ..... 10 2015 117 291.7

(51) Int. Cl.
*E05F 1/12* (2006.01)
*E05F 1/10* (2006.01)
(Continued)

(52) U.S. Cl.
CPC ..... *E05F 1/1261* (2013.01); *E05D 15/401* (2013.01); *E05F 1/1041* (2013.01);
(Continued)

(58) Field of Classification Search
CPC .... E05D 15/401; E05F 1/1261; E05F 1/1041; E05F 1/1058
See application file for complete search history.

(56) References Cited

U.S. PATENT DOCUMENTS 2,903,149 A * 9/1959 Turner ..... E05F 1/1058 217/60 E
3,763,519 A * 10/1973 Favre ..... E05F 1/105 16/72
(Continued)

FOREIGN PATENT DOCUMENTS

DE 102006013423 A1 9/2007
DE 202010015094 * 3/2012

*Primary Examiner* — Jeffrey O'Brien
(74) *Attorney, Agent, or Firm* — Lucian Wayne Beavers; Patterson Intellectual Property Law, PC

(57) ABSTRACT

The invention relates to a door holder for a cabinetry door that is displaceable between a closed and an open position, having a lever onto which the cabinetry door is fastenable, the lever being pivotable around a pivot shaft, and having a tensioning lever that is displaceably attached to the lever via a coupling piece, and the tensioning lever being mounted in stationary fashion. In such a door holder, reliable movement of the cabinetry door can be brought about in simple fashion if provision is made that an energy reservoir is indirectly or directly attached to the tensioning lever at the end facing away from the coupling piece.

19 Claims, 7 Drawing Sheets

(51) Int. Cl.

| | |
|---|---|
| ***E05D 15/40*** | (2006.01) |
| *E05F 3/22* | (2006.01) |
| *E05D 3/16* | (2006.01) |
| *E05F 5/06* | (2006.01) |
| *E05D 3/06* | (2006.01) |
| *E05F 5/08* | (2006.01) |

(52) U.S. Cl.
CPC ..... *E05F 1/1058* (2013.01); *E05D 3/06* (2013.01); *E05D 3/16* (2013.01); *E05F 3/22* (2013.01); *E05F 5/06* (2013.01); *E05F 5/08* (2013.01); *E05Y 2900/20* (2013.01)

(56) References Cited

U.S. PATENT DOCUMENTS 8,807,670 B2 * 8/2014 Blum ..... E05F 1/1276 312/319.2
8,959,709 B2 * 2/2015 Hasegawa ..... E05D 3/14 16/65
9,032,768 B2 * 5/2015 Hauer ..... E05D 15/401 70/174
9,151,101 B2 * 10/2015 Lowe ..... E05F 5/02
9,353,562 B2 * 5/2016 Oshima ..... E05F 1/14
9,719,283 B2 * 8/2017 Holzapfel ..... E05F 1/1253
10,244,920 B2 * 4/2019 Vanini ..... A47L 15/4261
10,352,081 B2 * 7/2019 Hirtsiefer ..... E05F 1/1269
10,407,962 B2 * 9/2019 Schluge ..... F16H 21/44
10,428,568 B2 * 10/2019 Brunnmayr ..... E05F 1/105
10,494,846 B2 * 12/2019 Schmid ..... E05F 1/1261
10,519,707 B2 * 12/2019 Cappellotto ..... E05D 15/40
10,590,688 B2 * 3/2020 Salice ..... E05D 11/00
10,590,692 B2 * 3/2020 Bohle ..... E05D 15/401
10,662,690 B2 * 5/2020 Schluge ..... E05F 1/1058
2020/0131828 A1 * 4/2020 Kaiser ..... E05F 3/20

* cited by examiner

FLAP HOLDER FOR A FURNITURE FLAP

The invention relates to a door holder for a cabinetry door that is displaceable between a closed and an open position, having a lever onto which the cabinetry door is fastenable, the lever being pivotable around a pivot shaft, and having a tensioning lever that is displaceably attached to the lever via a coupling piece, and the tensioning lever being mounted in stationary fashion.

A door holder of this kind is known from DE 10 2006 013 423 A1, in which a lever of two-armed configuration is used. The lever is immobilized in stationary fashion on the furniture carcass, pivotably via a pivot shaft. Two lever arms extend on either side of the pivot shaft. With the first lever arm, the lever can be fastened onto the door that is to be moved. The second lever arm is connected to a positioning lever. The positioning lever constitutes, together with a toggle lever arm, a toggle lever mechanism. For this purpose, the positioning lever and the toggle lever arm are connected to one another in the region of an articulation point. A tensioning spring is arranged in the region of the articulation point. The tensioning lever interacts with the toggle lever in such a way that the door, installed on the first lever arm, is to be held unassistedly in various open positions. This known door holder has the disadvantage that it requires a relatively large amount of installation space and is therefore perceived as intrusive in the interior of a furniture carcass. It has furthermore been found that the cabinetry door cannot be held unassistedly in any intermediate position on the movement path between the open position and the closed position.

The object of the invention is therefore to furnish a door holder of the kind mentioned initially which on the one hand occupies little installation space and at the same time enables secure holding of the cabinetry door over the entire displacement path between the open position and the closed position.

This object is achieved in that an energy reservoir is indirectly or directly attached to the tensioning lever at the end facing away from the coupling piece.

The present invention consequently makes possible a simple lever mechanism for which a small installation space is sufficient. In particular, the engagement of the energy reservoir at the end facing away from the coupling piece results in a design in which the individual articulation points of the lever kinematic system remain closely associated with one another over the entire movement range. It has furthermore been found that the fitting according to the present invention operates unequivocally and reliably because of the fact that the energy reservoir does not, as in the existing art, engage into a toggle lever mechanism, but instead applies its force directly onto the tensioning lever at the end facing away from the coupling piece. What can thereby be achieved is that the cabinetry door is reliably held in any adjustment position between the open position and the closed position.

According to a preferred variant embodiment of the invention, provision can be made that the lever comprises a holding extension that is embodied, in the form of an insertion extension, in such a way that a fastening portion is placeable onto it for attachment of the cabinetry door. The cabinetry doors can thereby be easily and quickly attached to the fitting.

A door holder according to the present invention can be characterized in that the lever comprises a coupling point onto which the coupling piece is pivotably fastened; and that the coupling point is arranged on the lever closer to the linkage point for the cabinetry door than the pivot shaft of the lever. As a result, the pivot shaft of the lever arm can be brought close to the stationary bearing of the tensioning lever. A further reduction in overall volume can be achieved with this feature.

A low level of parts complexity can be achieved by the fact that the coupling piece is connected to a lever arm of the tensioning lever, an extension in the form of a further lever arm being shaped onto the lever arm; and that the energy reservoir is indirectly or directly attached to the extension.

In practical use, it may be necessary to adapt the door holder to different door weights. This is easily possible with the door holder according to the present invention, thanks to the fact that the tensioning lever carries an adjusting element with which the linkage point of the energy reservoir on the tensioning lever is displaceable. Provision can be made in particular that the adjusting element comprises a thread on which a mounting piece having a counter-thread is held. Stepless displacement of the linkage point can thereby be achieved. The adjusting element preferably comprises an operating part that is accessible from the outer side of the housing. The adjustment can thus conveniently be made with the fitting installed, with no need to remove or open the housing for that purpose.

A particularly preferred variant of the invention is such that a damper, which with its damping force indirectly or directly damps, at least over a partial path, the movement of the lever from the open or a partly open position toward the closed position, is used. If the cabinetry door is moved vigorously from its open position into the closed position, the damper then prevents uncontrolled movement of the cabinetry door and, in particular, prevents the cabinetry door from striking hard against the furniture carcass, which would be perceived as unpleasant. Preferably the damper can be adjusted, in terms of its damping force and/or its damping travel, by means of a damping adjuster. The damping characteristics can thereby be modified, which offers advantages especially when the door holder is used in conjunction with cabinetry doors of different weights. For this purpose, provision can be made in particular that the damping adjuster carries a connector that is coupled to a slider; and that the slider interacts with a lever part of the lever kinematic system.

Additionally or alternatively, provision can also be made that the damper is displaceable in terms of its position. It is also conceivable for the contact point of the lever kinematic system with the damper to be displaceable. The damping behavior of the door holder can be modified in this manner as well.

The functionality of the door holder can be further improved by the fact that an immobilizing element, which in the open position is releasably held on, in particular is latched onto, a locking element, is used. The open position of the cabinetry door is unequivocally signaled to the user by way of this functionality.

One possible variant of the invention can be characterized in that a damping element, which is embodied to damp the displacement movement of the lever at least over a portion of the displacement path from the closed position into the open position, is provided. The opening movement can thereby be damped. In particular, damping can be provided in the last region of the displacement path. The cabinetry door can then be brought into the open position in decelerated and damped fashion shortly before the open position is reached.

The invention will be explained in further detail below with reference to an exemplifying embodiment depicted in the drawings, in which.

Figure 1:
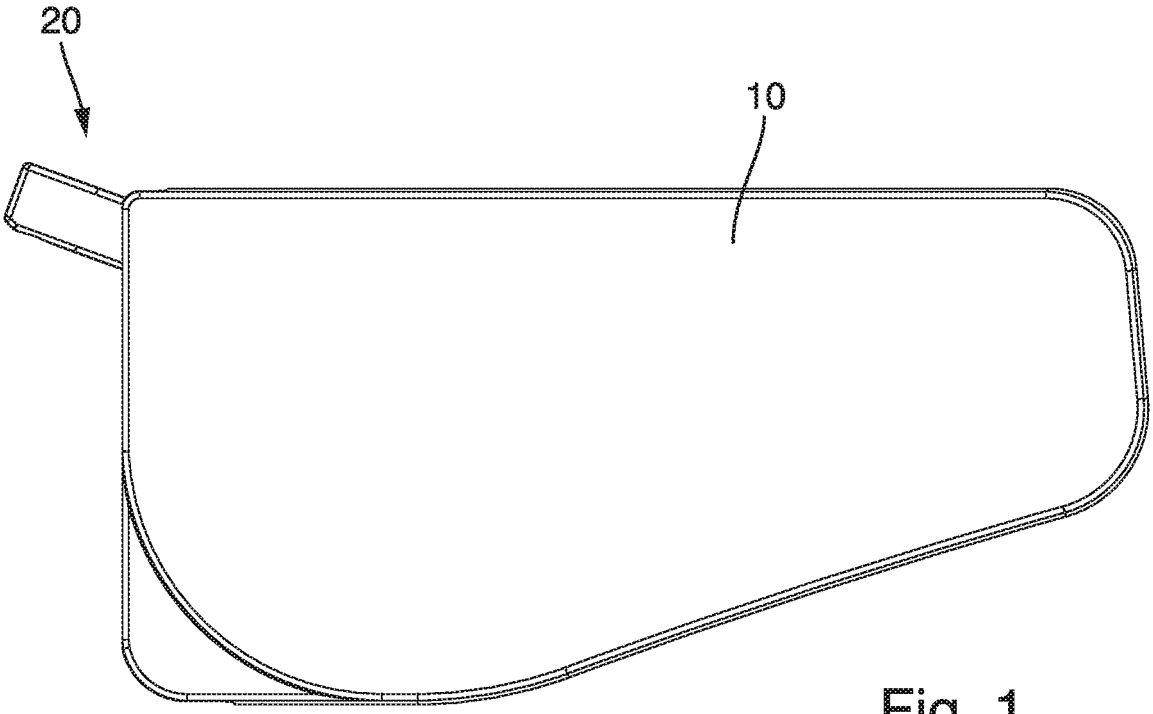
FIG. 1 is a side view of a door holder for a cabinetry door.
Figure 2:
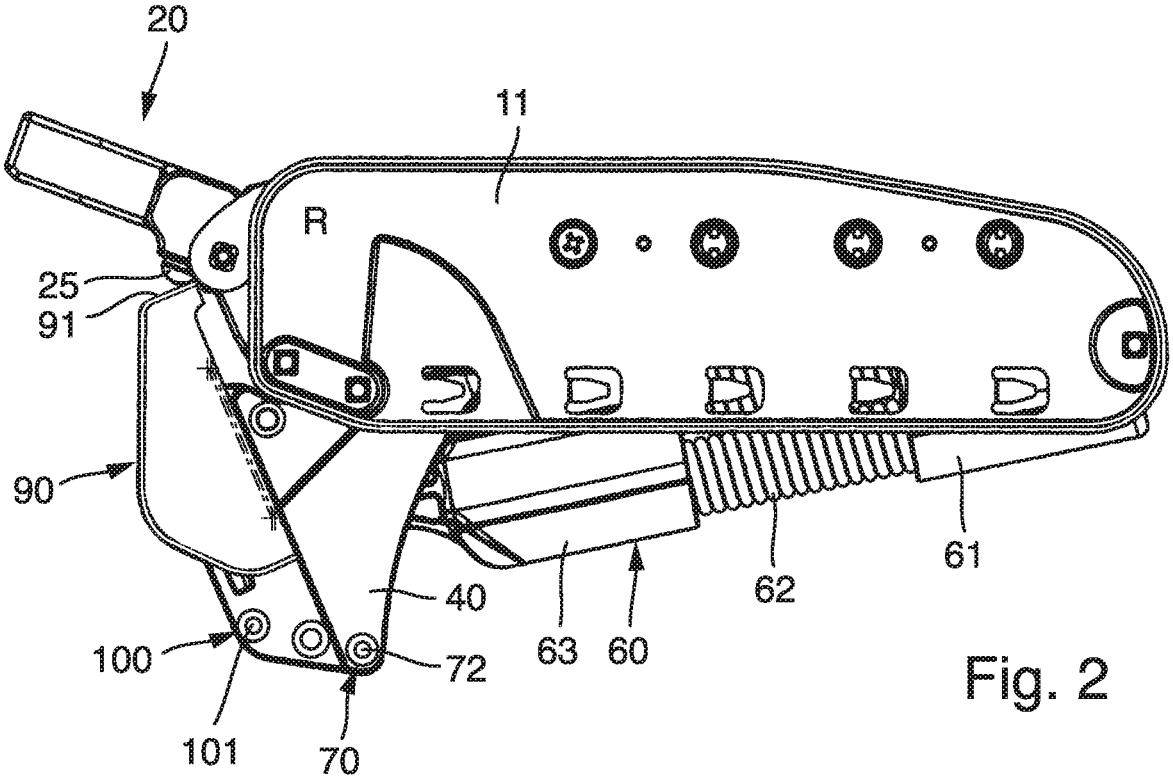
FIG. 2 shows the door holder according to FIG. 1 with the housing open.

FIG. 1 shows a door holder having a housing 10 and having a lever 20 projecting out of housing 10. FIG. 2 shows the door holder according to FIG. 1, housing 10 being open. In particular, one housing half has been removed in order to provide a view into the inner workings of the door holder. As shown in this illustration, the door holder encompasses two mounting plates 11, only one of which can be seen in FIG. 2. This mounting plate 11 has been removed in FIG. 3 so that second mounting plate 11 is visible. The two mounting plates 11 are held at a distance from one another by a spacer 50, and secured to that spacer 50. A lever kinematic system, which will be explained in more detail below, is accommodated between the two mounting plates 11.

The lever kinematic system encompasses a lever 20 that comprises a holding extension 21 in the form of an insertion extension. The door holder can be fastened onto a cabinetry door using holding extension 21. Either a folding door or a single door can be fastened onto the door holder. In the case of a folding door, two doors are arranged one above another and are connected to one another via a center hinge. The hinge axis of the center hinge is oriented horizontally. Usually the door holder is connected to the lower door of the folding door. For this, a profile section can be slid onto the insertion extension (holding extension 21) and fastened onto holding extension 21. At the end facing away from holding extension 21, the profile section is attached to a linkage. That linkage is connected to the lower folding door. Folding doors of this kind are known from the existing art and are described, for example, in DE 10 2006 013 423 A1. As has already been mentioned above, a single door can also be pivotably connected to a furniture carcass using the door holder, in which case the pivot shaft of the single door also extends horizontally.

Figure 3:
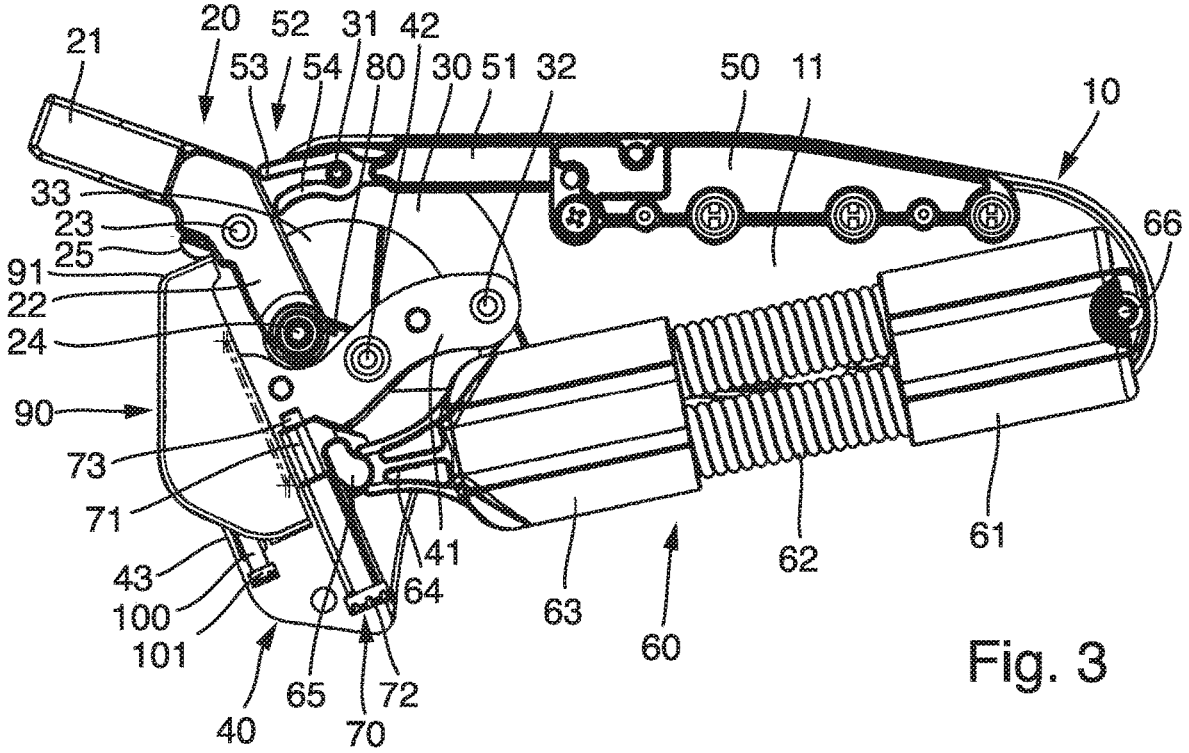
FIG. 3 shows the door holder according to FIGS. 1 and 2, one mounting plate having been removed.

Lever 20 comprises, adjacently to holding extension 21, a fastening portion 22. The lever 20 may also be referred to as a mounting lever 20. Lever 20 is connected via a pivot shaft 24 to the two mounting plates 11. Each mounting plate 11 possesses a connecting part 80 for that purpose. This connecting part 80 can, for example, be curved out of mounting plate 11 as a reinforcement, and thus connected integrally thereto. Rigid attachment of lever 20 in the region of pivot shaft 24 is thereby effected. As seen in FIG. 3 the mounting plates 11 are part of the housing 10 and thus the lever 20 may be described as being pivotally attached to the housing 10 about a fixed first pivotal axis defined by the pivot shaft 24. Lever 20 furthermore possesses a coupling point 23. A coupling piece 30 can be pivotably fastened onto this coupling point 23. The coupling piece 30 may be described as being pivotally connected to the lever 20 about a movable third pivotal axis defined by the coupling point 23. Coupling piece 30 can comprise, as in the present exemplifying embodiment, two sub-portions that preferably are structurally identical. FIG. 3 shows one of the sub-portions. The second sub-portion is fastened onto coupling point 23, parallel to the first sub-portion, on the opposite side of lever 20. Coupling piece 30 is configured in curved fashion. At its end facing away from lever 20, coupling piece 30 comprises a coupling point 32. Coupling piece 30 is attached, via this coupling point 32, pivotably to a tensioning lever 40. The coupling piece 30 may be described as being pivotally connected to the tensioning lever 40 at a movable fourth pivotal axis defined by the coupling point 32. As is evident from FIG. 3, coupling piece 30 possesses an immobilizing element 31. As depicted here, this immobilizing element 31 can be arranged between the two sub-portions of coupling piece 30. It can in particular be such that it interconnects the two sub-portions in reinforcing fashion.

Tensioning lever 40 is embodied as a two-armed lever and comprises a first lever arm that extends out from a bearing 42. Tensioning lever 40 furthermore encompasses, as a second lever arm, an extension 43 that likewise adjoins bearing 42. Tensioning lever 40 is pivotably connected by means of bearing 42, in stationary fashion, to one of, preferably to both, mounting plates 11. As seen in FIG. 3 the mounting plates 11 are part of the housing 10 and thus the tensioning lever 40 may be described as being pivotally attached to the housing 10 about a fixed second pivotal axis defined by the bearing 42. Bearing 42, as well as pivot shaft 24, can be fastened onto connecting part 80 in order to achieve torsionally stiff fastening. As seen in FIG. 3, the fixed first pivotal axis defined by the pivot shaft 24 is separated from the fixed second pivotal axis defined by the bearing 42 by a first distance. And as seen in FIG. 3, that first distance is less than a distance from the fixed first pivotal axis defined by the pivot shaft 24 to the movable third pivotal axis defined by the coupling point 23. And as further seen in FIG. 3, the first distance is less than a distance from the fixed second pivotal axis defined by the bearing 42 to the movable fourth pivotal axis defined by the coupling point 32. As is further shown in FIGS. 3 and 6, the housing 10, the mounting lever 20, the tensioning lever 40 and the coupling piece 30 define a kinematic linkage in the form of a four-bar linkage having the first, second, third and fourth pivotal axes, the kinematic linkage being configured such that upon movement from the open position of FIG. 3 to the closed position of FIG. 6 the movable third pivotal axis defined by the coupling point 23 moves along a curved path in front of the fixed first pivotal axis defined by the pivot shaft 24. As is further shown in FIG. 6, the coupling piece 30 is a curved coupling piece having an exposed concave contour, and in the closed position of FIG. 6 the fixed first pivotal axis defined by the pivot shaft 24 is received in the exposed concave contour.

A slider 90 is linearly displaceably mounted on tensioning lever 40 in the region of extension 43. Slider 90 interacts with a stop 25. Stop 25 is attached to lever 20. In FIG. 3, slider 90 has been removed for better clarity. As is apparent from this illustration, a damping adjuster 100 is installed on extension 43 of tensioning lever 40. This damping adjuster comprises an operating part 101. Damping adjuster 100 can advantageously comprise in particularly simple fashion, as depicted here, a screw element. Operating part 101 is embodied as a screw head adjoined by a thread. Damping adjuster 100 furthermore encompasses a connector 102 that is guided linearly displaceably on damping adjuster 100. In the present exemplifying embodiment, for example, connector 102 can comprise an internal thread in the form of a nut. Upon an adjustment at operating element 101, connector can thus be steplessly displaced in a longitudinal direction of the thread. As is evident from FIG. 4, damping adjuster 100 is held on tensioning lever 40 freely rotatably in a circumferential direction, but axially nondisplaceably.

A positioning element 70 is furthermore fastened onto tensioning lever 40 in the region of extension 43. Positioning element 70, like damping adjuster 100, can be embodied as a screw element. Positioning element 70 likewise possesses an operating part 72. Operating part 72 can be adjoined, as depicted here, by a thread 73. A holder 71 in the form of a nut is screwed onto thread 73. Upon a rotation of operating part 72, holder 71 is thus displaced steplessly along thread 73. Positioning element 70 is held on extension 43 of tensioning lever 40 freely rotatably in a circumferential direction, but nondisplaceably in an axial direction. A mounting piece 65 is fastened onto holder 71, preferably connected integrally to holder 71. The holder 71 may be described as having a counter-thread engaged with the thread 73, and because the holder 71 is connected integrally to the mounting piece 65 the counter-thread may be described as a counter-thread of the mounting piece 65. Mounting piece 65 serves for attachment of an energy reservoir 60. The energy reservoir 60 may be described as being connected to the tensioning lever 40 at a point of connection defined by the mounting piece 65. As can be seen in FIG. 3, the fixed second pivot axis defined by bearing 42 lies between the connection point defined by mounting piece 65 and the coupling piece 30. Energy reservoir 60 possesses two holders 61 and 62. Holder 61 is pivotably articulated by means of a pivot bearing 66 on at least one of the two mounting plates 11, preferably on both mounting plates 11. Holder 61 is equipped with a receptacle into which at least one tensioning element 62 is inserted. In the present case, two tensioning elements 62 in the form of compression springs are inserted into holder 61. Those ends of tensioning elements 62 which are located oppositely from holder 61 are inserted into receptacles of holder 63. Holder 63 encompasses a coupling member 64. This coupling member 64 is connected to mounting piece 65, a pivot bearing being constituted between coupling member 64 and mounting piece 65.

Figure 5:
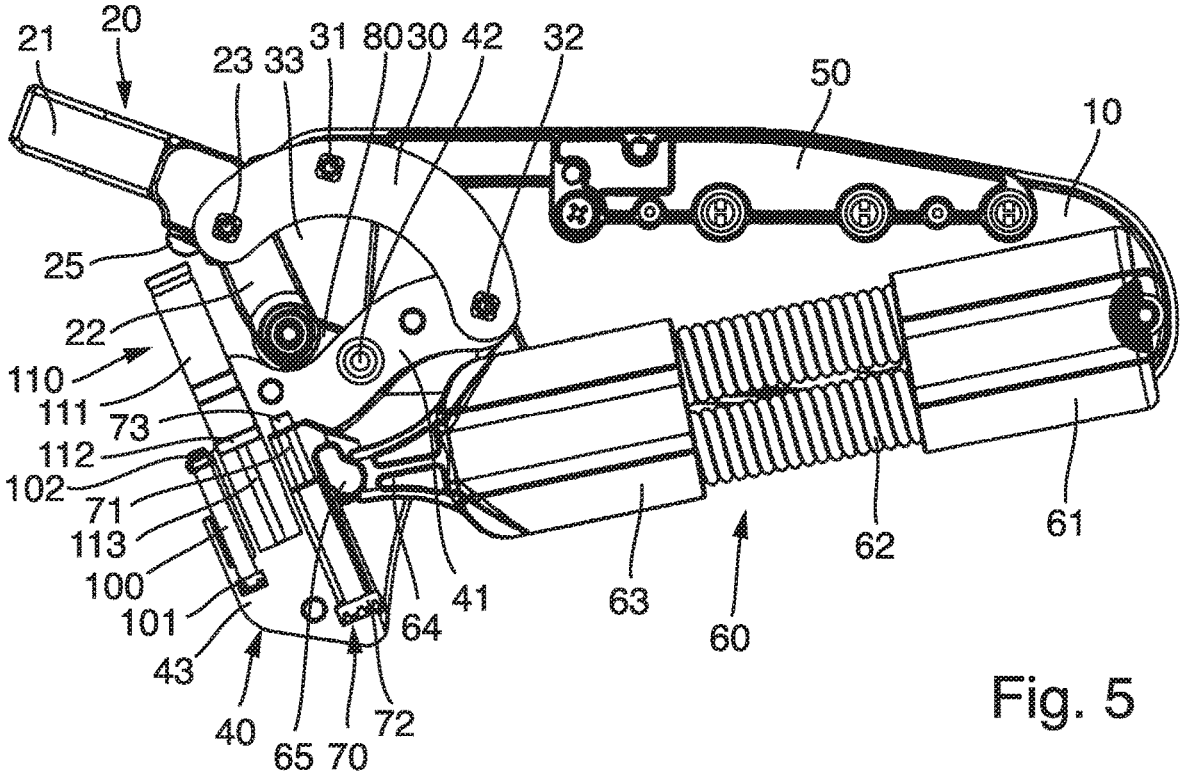
FIG. 5 shows what is depicted in FIG. 4, with a damper installed.

FIG. 5 is a depiction showing an installation modified as compared with FIG. 1. As is evident from FIG. 5, coupling piece 30, comprising its two sub-portions, is installed complete. The two sub-portions enclose lever 20 and tensioning lever 40 in the region of coupling point 23 and coupling point 32, which ensures stable load transfer.

As is further evident from FIG. 5, tensioning lever 40 receives a damper 110. Damper 110 is embodied in the present case as a fluid damper. It comprises a cylinder 111 in which a piston is linearly displaceable against a fluid. It is conceivable to use an air damper or a liquid damper, in particular an oil damper. Damper 110 also possesses a piston rod 113 that is connected to piston 112. At the end facing away from piston 112, piston rod 113 is connected to tensioning lever 40. Slider 90 shown in FIG. 3 can then be placed, in the manner of a housing, over damper 110. A fastening portion, to which cylinder 111 is attached, is provided in slider 90. Connector 102 of damping adjuster 100 is positively connected to slider oppositely to the damping direction. In the damping direction, conversely, it is disengaged with respect to slider 90. As a result, upon a displacement of connector 112 oppositely to the damping direction, slider 90 can be displaced linearly on tensioning lever 90. Damper 110 preferably encompasses a tensioning spring that causes it to be held, in its idle position, in the extended position shown in FIG. 5. When slider 90 is then displaced oppositely to the damping direction, cylinder 111 of damper 110 automatically slides along thanks to the tensioning force of the spring, and thus always remains in contact with slider 90. As is evident, for example, from FIG. 2, slider 90 has a supporting portion 91 that interacts with a stop 25 of lever 20. Upon a displacement of lever 20 proceeding from the position shown in FIG. 2, stop 25 presses onto supporting portion 91. Because slider 90 is then disengaged in a damping direction with respect to damping adjuster 100, slider 90 can be displaced linearly against the damping force of damper 110.

The damping travel of damper 110 can thus be adjusted as a consequence of an adjustment of damping adjuster 100. The damping behavior of damper 110 can thereby be modified. In particular, the impingement point of stop 25 on supporting portion 91 of the slider can be displaced. The available damping travel can thus be varied.

It is apparent from FIG. 2 that tensioning lever 40 is constructed from two structurally identical, preferably mirror-symmetrical, components that are placed against one another along the separating plane extending in the drawing plane. The two components of tensioning lever 40 thus enclose damping adjuster 100, positioning element 70, and mounting piece 65, as is evident from FIG. 2. Operating parts 101 and 72 of damping adjuster 100 and of positioning element 70 are then accessible through openings in tensioning lever 40, as is evident from FIG. 2. A tool, for example a screwdriver, can thus be inserted laterally through the corresponding openings of clamping lever 40 so that it can come into engagement with operating parts 101 and 72. Operating parts 101 and 72 are embodied in crown-like fashion. The result is to constitute, with the screwdriver, a kind of angle linkage that allows positioning element 70 and damping adjuster 100 to be rotated.

Figure 4:
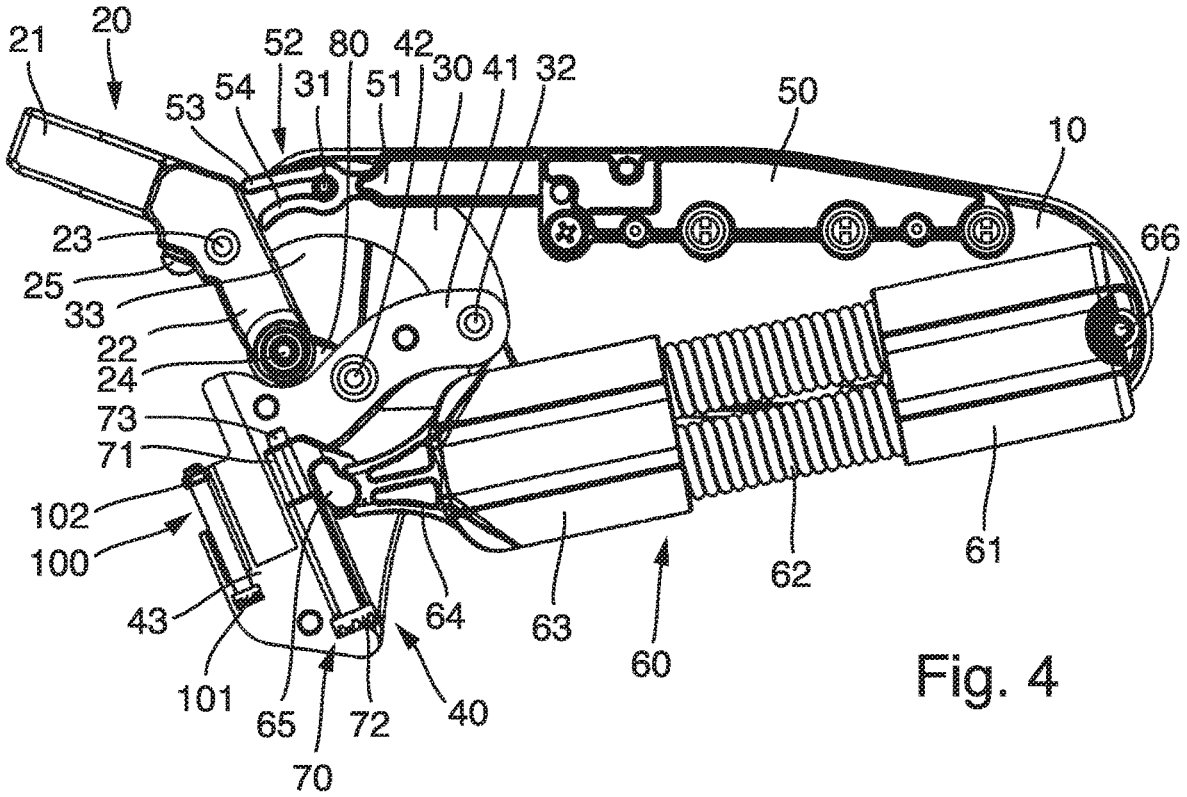
FIG. 4 shows what is depicted in FIG. 3, except that a slider has been removed.
Figure 6:
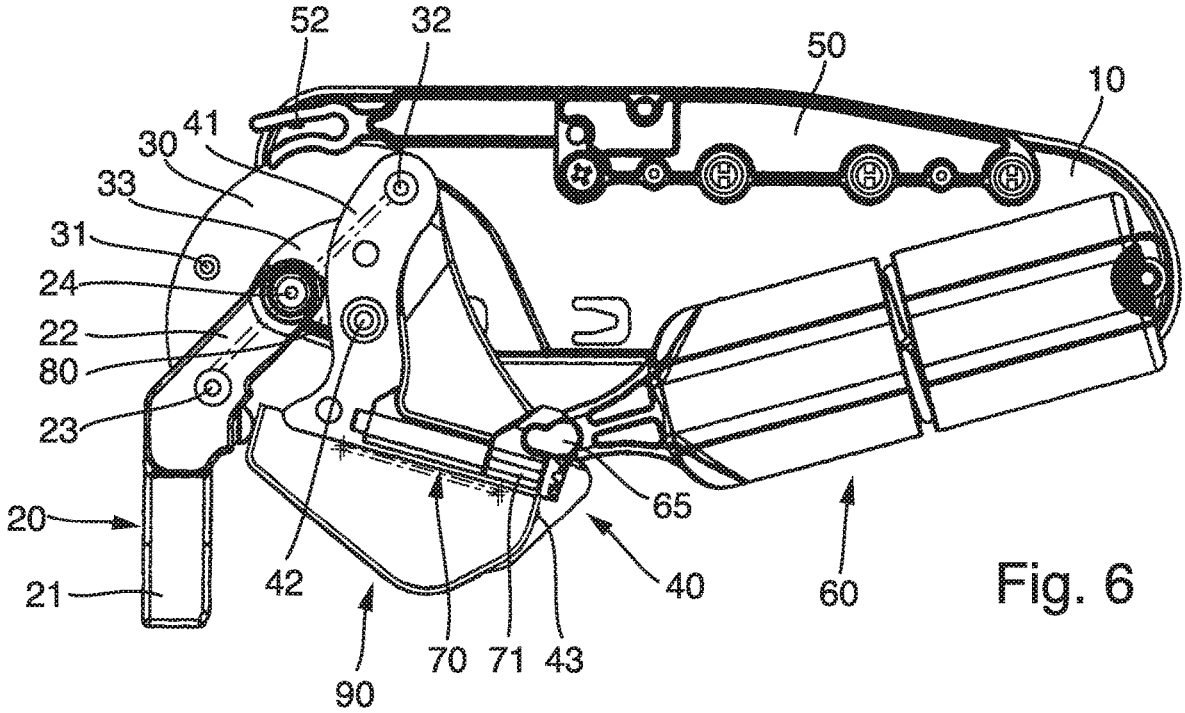
FIG. 6 shows what is depicted in FIG. 3, except that the door holder is in the closed position.

It is evident from FIGS. 3, 4, and 6 that an arm 51 is fastened onto spacer 50. Arm 51 carries, at its end facing away from spacer 50, a locking element 52. This locking element 52 can comprise one or two spring elements, preferably in the form of spring arms 53, 54. A receptacle is formed between the two spring elements. Firstly a guidance portion is formed, which transitions into a latching portion. Locking element 52 is embodied to interact with immobilizing element 31 of coupling piece 30. In the open position shown in FIG. 3, immobilizing element 31 is held releasably in the latching receptacle of locking element 52. In the closed position according to FIG. 6, however, immobilizing element 31 is out of engagement with locking element 52. When the door holder is moved out of the closed position shown in FIG. 6 into the open position, immobilizing element 31 slides along one or both spring arms 53, 54 with the result that spring arms 53, 54 bend apart. Immobilizing element 31 can thus latch into the latching receptacle of locking element 52.

The operation of the door holder will be explained below in further detail. When the door holder is displaced out of the open position shown in FIG. 3, lever 20 moves counter-clockwise and coupling piece 30 is pivoted via coupling point 23. As a result, immobilizing element 31 comes out of engagement with locking element 52. At the same time, coupling piece 30 pulls tensioning lever 40 against coupling point 32. Coupling piece 30 is thus embodied as a pulling element. Tensioning lever 40 becomes pivoted counter-clockwise around the stationary bearing 42. Energy reservoir 60 applies a compressive force acting between pivot bearing 66 and mounting piece 65. Upon a counter-clockwise displacement of tensioning lever 40, energy reservoir 60 is thus displaced against a compressive force. This ensures that a cabinetry door immobilized on lever 20 is securely held in any position between the open and the closed position. It can therefore conveniently be brought by a user from the open into the closed position with little application of force. At the same time, damper 110 produces damping of the closing movement. This prevents the cabinetry door from striking unpleasantly hard against the furniture carcass if it is vigorously thrown into the closed position. Upon its movement from the open position into the closed position, coupling point 23 passes through the connecting line between coupling point 32 and pivot shaft 24, as depicted in FIG. 6. As soon as the connecting line has been traversed, and the dead center point thus passed through, energy reservoir 60 pushes lever 20 into the closed position via the lever kinematic system. What is achieved thereby is that over the last portion of the displacement path of the cabinetry door, the latter is securely brought into and held in the closed position. When the cabinetry door is then opened, conversely, lever 21 must firstly be pulled out of the closed position against the force of energy reservoir 60 until coupling point 23 passes through the connecting line between pivot shaft 24 and coupling point 32. The force direction then reverses, and the cabinetry door is again held unassistedly in any open position. This action as shown in comparing FIGS. 3 and 6, may be described as the kinematic linkage being configured such that as the mounting lever 20 moves from the open position of FIG. 3 to the closed position of FIG. 6 the movable third pivot axis defined by the coupling point 23 moves over a top dead center line (shown dashed in FIG. 6) extending through the movable fourth pivotal axis defined by the coupling point 32 and the fixed first pivotal axis defined by the pivot shaft 24 such that in the closed position of FIG. 6 the energy reservoir 60 pushes the mounting lever 20 toward the closed position of FIG. 6.

FIG. 6 further symbolically depicts the fact that mounting piece 65 can be displaced by a displacement of positioning element 70. The effective lever arm between mounting piece 65 and bearing 42 is thereby lengthened. The door holder can accordingly be adjusted for different door weights using positioning element 70.

One special feature of the door holder according to the present invention is that upon displacement from the open position toward the closed position, coupling point 23 is displaced in curved fashion in front of pivot shaft 24, which promotes a compact design.

A further special feature is that coupling piece 30 has an exposed contour portion 33. In the closed position, the lever kinematic system travels into said portion with the region that comprises pivot shaft 24, as is evident from FIG. 6. In the present exemplifying embodiment, the exposed contour portion 33 is constituted by a curved contour of coupling piece 30. A compact design can be achieved with this feature as well.

Figure 7:
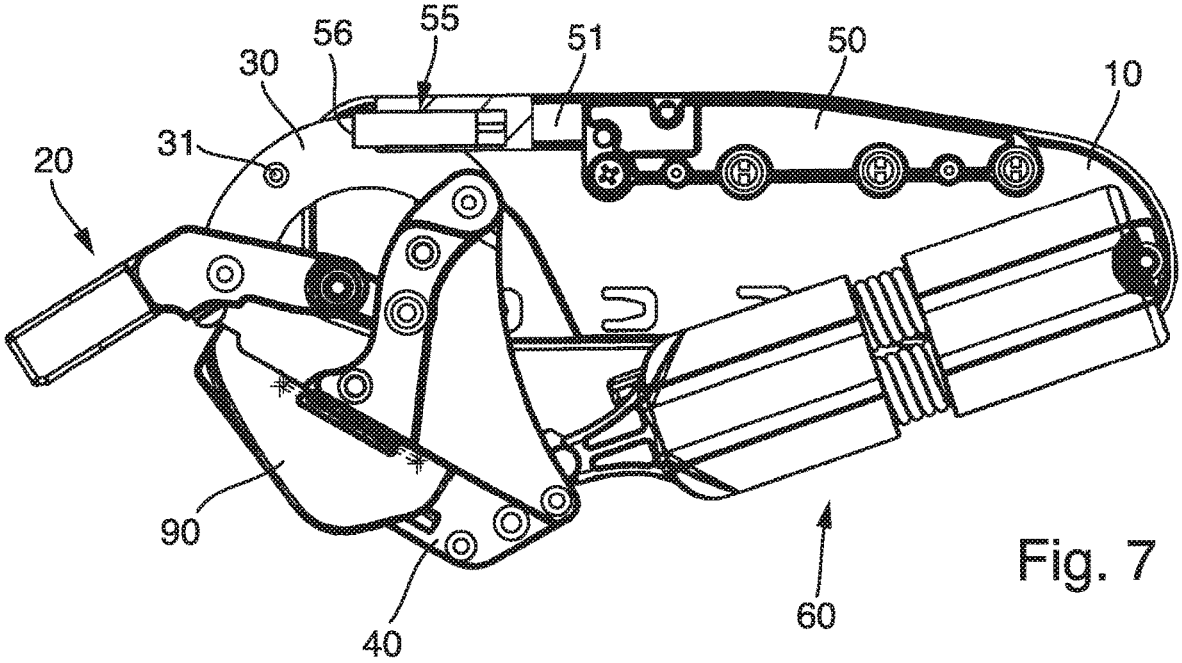
FIG. 7 shows a modified variant design of the door holder according to FIGS. 1 to 6.

FIG. 7 shows a modified variant design of the door holder according to FIGS. 1 to 6. As is apparent from this illustration, a damping element 55 is arranged on arm 51 of spacer 50. The damping element is embodied in the present case as a piston damper having a cylinder and having a piston displaceable therein against a fluid. Damping element 55 forms an impingement point 56. This impingement point interacts with immobilizing element 31 of coupling piece 30. Damping element 55 can of course also be arranged at a different point, and can interact with any other stop of the lever kinematic system. Immobilizing element 31 (or the stop) is arranged so that the displacement of the door holder from the closed position into the open position is damped. The damping occurs not over the entire path, but only in the last region. The cabinetry door can thereby be brought into its open position in damped fashion. Energy reservoir 60 is designed so that it works against the damping force of damping element 55. The cabinetry door is thus brought unassistedly into the open position, and damped in that context.

It is evident from the statements above that with the door holder according to the present invention, a cabinetry door can be reliably displaced between an open and a closed position (and vice versa), the cabinetry door being capable of being reliably held unassistedly in any intermediate position along the displacement path. The door holder comprises for that purpose a lever 20 onto which the cabinetry door is fastenable, and which is pivotable around a pivot shaft 24. The door holder further comprises tensioning lever 40, which is displaceably attached to lever 20 by means of coupling piece 30. Tensioning lever 40 is mounted in stationary fashion. Energy reservoir 60 is furthermore indirectly or directly attached to tensioning lever 40, specifically at the end facing away from coupling piece 30.

The invention claimed is:

1. A door holder for a cabinetry door of a piece of furniture, the door holder being displaceable between a closed position and an open position, the door holder comprising:

a housing configured to be fixed to the piece of furniture;

a mounting lever pivotally attached to the housing about a fixed first pivotal axis, the mounting lever being configured to have the cabinetry door fixedly mounted on the mounting lever;

a tensioning lever pivotally attached to the housing about a fixed second pivotal axis;

a coupling piece pivotally connected to the mounting lever about a movable third pivotal axis, and pivotally connected to the tensioning lever about a movable fourth pivotal axis;

an energy reservoir connected to the tensioning lever at a point of connection located such that the fixed second pivotal axis lies between the point of connection and the coupling piece;

wherein the fixed first and second pivotal axes are separated by a first distance;

wherein the first distance is less than a distance from the fixed first pivotal axis to the movable third pivotal axis; and wherein the first distance is less than a distance from the fixed second pivotal axis to the movable fourth pivotal axis.

2. The door holder of claim 1, wherein:

the mounting lever includes an insertion extension configured such that a fastening portion of the cabinetry door is receivable on the insertion extension for attachment of the cabinetry door to the mounting lever.

3. The door holder of claim 1, wherein:

the mounting lever includes an attachment portion for fixed attachment of the cabinetry door; and the movable third pivotal axis is closer to attachment portion than is the fixed first pivotal axis.

4. The door holder of claim 1, wherein:

the housing, the mounting lever, the tensioning lever and the coupling piece define a kinematic linkage in the form of a four-bar linkage having the first, second, third and fourth pivotal axes, the kinematic linkage being configured such that upon movement from the open position to the closed position the movable third pivotal axis moves along a curved path in front from of the fixed first pivotal axis.

5. The door holder of claim 1, wherein:

the housing, the mounting lever, the tensioning lever and the coupling piece define a kinematic linkage in the form of a four-bar linkage having the first, second, third and fourth pivotal axes; and the kinematic linkage is configured such that as the mounting lever moves from the open position to the closed position the movable third pivot axis moves over a top dead center line extending through the movable fourth pivotal axis and the fixed first pivotal axis such that in the closed position the energy reservoir pushes the mounting lever toward the closed position.

6. The door holder of claim 1, wherein:

the tensioning lever includes first and second lever arms extending from the fixed second pivotal axis;

the movable fourth pivotal axis is located on the first lever arm of the tensioning lever; and the point of connection of the energy reservoir to the tensioning lever is located on the second lever arm of the tensioning lever.

7. The door holder of claim 1, further comprising:

an adjusting element configured to adjust the point of connection of the energy reservoir to the tensioning lever.

8. The door holder of claim 7, wherein:

the adjusting element includes a thread on which a mounting piece having a counter-thread is held.

9. The door holder of claim 7, wherein:

the adjusting element includes an operating part accessible from an outer side of the housing.

10. The door holder of claim 1, further comprising:

a damper configured to dampen a movement of the mounting lever over at least a part of a path of movement from the open position or a partially open position toward the closed position.

11. The door holder of claim 10, wherein:

the damper includes a damping adjuster configured such that a damping force provided by the damper is adjustable.

12. The door holder of claim 11, wherein:

the damping adjuster includes a connector coupled to a slider, and the slider interacts with one of the mounting lever and the tensioning lever.

13. The door holder of claim 10, wherein:

the damper is configured such that a damping travel of the damper is adjustable.

14. The door holder of claim 10, wherein:

the damper is configured such that the damper is displaceable in position relative to the housing.

15. The door holder of claim 10, wherein:

the damper is configured to be contacted at a contact point by a moveable component of the door holder, and the contact point is displaceable in position relative to the housing.

16. The door holder of claim 1, further comprising:

an immobilizing element configured such that the immobilizing element moves with the mounting lever; and a locking element fixed relative to the housing, wherein in the open position the mounting lever is held fixed relative to the housing by engagement of the immobilizing element with the locking element.

17. A door holder for a cabinetry door of a piece of furniture, the door holder being displaceable between a closed position and an open position, the door holder comprising:

a housing configured to be fixed to the piece of furniture;

a mounting lever pivotally attached to the housing about a fixed first pivotal axis, the mounting lever being configured to have the cabinetry door fixedly mounted on the mounting lever;

a tensioning lever pivotally attached to the housing about a fixed second pivotal axis;

a coupling piece pivotally connected to the mounting lever about a movable third pivotal axis, and pivotally connected to the tensioning lever about a movable fourth pivotal axis;

an energy reservoir connected to the tensioning lever at a point of connection located such that the fixed second pivotal axis lies between the point of connection and the coupling piece;

wherein the housing, the mounting lever, the tensioning lever and the coupling piece define a kinematic linkage in the form of a four-bar linkage having the first, second, third and fourth pivotal axes; and wherein the coupling piece is a curved coupling piece having an exposed concave contour, and in the closed position the fixed first pivotal axis is received in the exposed concave contour.

18. The door holder of claim 17, wherein:

the fixed first and second pivotal axes are separated by a first distance;

the first distance is less than a distance from the fixed first pivotal axis to the movable third pivotal axis;

the first distance is less than a distance from the fixed second pivotal axis to the movable fourth pivotal axis; and the kinematic linkage is configured such that upon movement from the open position to the closed position the movable third pivotal axis moves along a curved path in front of the fixed first pivotal axis.

19. The door holder of claim 17, wherein:

the kinematic linkage is configured such that as the mounting lever moves from the open position to the closed position the movable third pivot axis moves over a top dead center line extending through the movable fourth pivotal axis and the fixed first pivotal axis such that in the closed position the energy reservoir pushes the mounting lever toward the closed position.

* * * * *